US006188979B1

(12) United States Patent
Ashley

(10) Patent No.: US 6,188,979 B1
(45) Date of Patent: Feb. 13, 2001

(54) METHOD AND APPARATUS FOR ESTIMATING THE FUNDAMENTAL FREQUENCY OF A SIGNAL

(75) Inventor: James Patrick Ashley, Naperville, IL (US)

(73) Assignee: Motorola, Inc., Schaumburg, IL (US)

( * ) Notice: Under 35 U.S.C. 154(b), the term of this patent shall be extended for 0 days.

(21) Appl. No.: 09/086,509

(22) Filed: May 28, 1998

(51) Int. Cl.[7] ..... G10L 19/14

(52) U.S. Cl. ..... 704/205; 704/207; 704/214; 704/262

(58) Field of Search ..... 704/214, 213, 704/224, 211, 262, 207, 205

(56) References Cited

U.S. PATENT DOCUMENTS 4,776,014 * 10/1988 Zinser ..... 704/262
5,054,072 * 10/1991 McAulay et al. ..... 704/207
5,664,052 * 9/1997 Nishiguchi et al. ..... 704/214
5,809,455 * 9/1998 Nishiguchi et al. ..... 704/214

* cited by examiner

*Primary Examiner*—David R. Hudspeth
*Assistant Examiner*—Vijay Chawan
(74) *Attorney, Agent, or Firm*—Randi L. Dulaney

(57) ABSTRACT

A method and apparatus for improved pitch period ($\tau$) estimation in a compression system is disclosed. The system uses original estimates of integer lag ($\tau_0$) and open-loop prediction gain ($\beta_{ol}$) as input to an adaptive filter parameter initialization block (304) which supplies inputs to a plurality of adaptive filter elements (306–308). Adaptive filter elements (306–308) provide information regarding the harmonics of the residual signal ($\epsilon(n)$) to an adaptive filter parameter analysis block (310). Adaptive filter parameter analysis block (310) estimates the fundamental frequency of the residual signal based on the analysis of the harmonics and outputs a pitch period ($\tau$) for eventual use in a delay contour computation.

6 Claims, 4 Drawing Sheets

| LAG RANGE | LAG RESOLUTION | NUMBER IN RANGE |
|---|---|---|
| 21 TO 22-2/3 | 1/3 | 6 |
| 23 TO 34-5/6 | 1/6 | 72 |
| 35 TO 49-2/3 | 1/3 | 45 |
| 50 TO 89-1/2 | 1/2 | 80 |
| 90 TO 142 | 1 | 52 |

-PRIOR ART- $f_{table}$={

395.1096, 375.4677, 358.8803, 344.6059, 331.2648, 320.5528, 311.7706,
303.3890, 294.8202, 286.9527, 280.3353, 274.7313, 269.3502, 264.7591,
260.4984, 256.5428, 252.7434, 248.7145, 245.2264, 242.5208, 239.8938,
237.4418, 235.1247, 232.8330, 230.4177, 228.0408, 225.6160, 223.0021,
220.3366, 217.8871, 215.5826, 213.4089, 211.2554, 208.9051, 206.5807,
204.3353, 202.0702, 199.6849, 197.3079, 195.5002, 193.6565, 192.0399,
190.5473, 189.0354, 187.4094, 185.6063, 183.7496, 181.8147, 179.9768,
178.3340, 176.8487, 175.4076, 173.9407, 172.4626, 170.9854, 169.5585,
168.0904, 166.2729, 164.5547, 162.9461, 161.2907, 159.8364, 158.4132,
156.9809, 155.4136, 153.6937, 151.9048, 150.2928, 148.7086, 147.1853,
145.5967, 144.0839, 142.5958, 141.1645, 139.7480, 138.4339, 137.1649,
135.8683, 134.5930, 133.3143, 132.1346, 131.0542, 129.9791, 128.9869,
128.0691, 127.1344, 126.2675, 125.3518, 124.3711, 123.4546, 122.5868,
121.6670, 120.7854, 119.9130, 119.0361, 117.9892, 116.8999, 115.8510,
114.8749, 113.7655, 112.7285, 111.6506, 110.4579, 109.2836, 108.2150,
107.1638, 106.0936, 104.8398, 103.6458, 102.4101, 101.1859, 99.7748,
98.3227, 96.8067, 95.1783, 93.6211, 91.8814, 89.9341, 87.9994,
85.9295, 83.8983, 81.8277, 79.6511, 77.2465, 74.6894, 72.3447,
69.9938, 67.5036,

| | AVERAGE SHIFT | IMPROVEMENT |
|---|---|---|
| PRIOR ART | 2.49 | — |
| INVENTION | 1.98 | 20.5% |

METHOD AND APPARATUS FOR ESTIMATING THE FUNDAMENTAL FREQUENCY OF A SIGNAL

FIELD OF THE INVENTION

The present invention relates, in general, to communication systems and, more particularly, to coding information signals in such communication systems.

BACKGROUND OF THE INVENTION

Digital speech compression systems typically require estimation of the fundamental frequency of an input signal. The fundamental frequency $f_0$ is usually estimated in terms of the pitch period $\tau_0$ (otherwise known as "lag"). The two are related by the expression $$\tau_0 = \frac{f_s}{f_0}, \tag{1}$$

where the sampling frequency $f_s$ is commonly 8000 Hz for telephone grade applications.

Since a speech signal is generally non-stationary, it is partitioned into finite length vectors called frames (e.g., 10 to 40 ms), each of which are presumed to be quasi-stationary. The parameters describing the speech signal are then updated at the associated frame length intervals. The original Code Excited Linear Prediction (CELP) algorithm further updates the pitch period (using what is called Long Term Prediction, or LTP) information on shorter subframe intervals, thus allowing smoother transitions from frame to frame. It was also noted that although $\tau_0$ could be estimated using open-loop methods, far better performance was achieved using the closed-loop approach. Closed-loop methods involve an exhaustive search of all possible values of $\tau_0$ (typically integer values from 20 to 147) on a subframe basis, and choosing the value that satisfies some minimum error criterion.

An enhancement to this method involves allowing $\tau_0$ to take on fractional values. An example of a practical implementation of this method can be found in the GSM half rate speech coder, and is shown in FIG. 1. Here, lags within the range of 21 to 22⅔ are allowed ⅓ sample resolution, lags within the range of 23 to 34⅚ are allowed ⅙ sample resolution, and so on. In order to keep the search complexity low, a combination of open-loop and closed loop methods is used. The open-loop method involves generating an integer lag candidate list using an autocorrelation peak picking algorithm. The closed-loop method then searches the allowable lags in the neighborhood of the integer lag candidates for the optimal fractional lag value. Furthermore, the lags for subframes 2, 3, and 4 are coded based on the difference from the previous subframe. This allows the lag information to be coded using fewer bits since there is a high intraframe correlation of the lag parameter. Even so, the GSM HR codec uses a total of 8+(3×4)=20 bits every 20 ms (1.0 kbps) to convey the pitch period information.

In an effort to reduce the bit rate of the pitch period information, an interpolation strategy was developed that allows the pitch information to be coded only once per frame (using only 7 bits→350 bps), rather than with the usual subframe resolution. This technique is known as relaxed CELP (or RCELP), and is the basis for the recently adopted enhanced variable rate codec (EVRC) standard for Code Division Multiple Access (CDMA) wireless telephone systems. The basic principle is as follows.

The pitch period is estimated for the analysis window centered at the end of the current frame. The lag (delay) contour is then generated, which consists of a linear interpolation of the past frame's lag to the current frame's lag. The linear prediction (LP) residual signal is then modified by means of sophisticated polyphase filtering and shifting techniques, which are designed such that the ⅛ sample interpolation boundaries are not crossed during perceptually critical instances in the waveform. The primary reason for this residual modification process is to account for errors introduced by the open-loop integer lag estimation process. For example, if the integer lag is estimated to be 32 samples, when in fact the true lag is 32.5 samples, the residual waveform can be in conflict with the estimated lag by as many as 2.5 samples in a single 160 sample frame. This can severely degrade the performance of the LTP. The RCELP algorithm accounts for this by shifting the residual waveform during perceptually insignificant instances in the residual waveform (i.e., low energy) to match the delay contour. In the event that there are no such opportunities for shifting, the shift count is accumulated and reserved for use during the next frame. By modifying the residual waveform to match the estimated delay contour, the effectiveness of the LTP is preserved, and the coding gain is maintained. In addition, the associated perceptual degradations due to the residual modification are claimed to be insignificant.

But, while this last claim may be true for medium bit rate coders such as the EVRC full rate mode (i.e., 8.5 kbps), it is less apparent for the EVRC half rate mode, which operates at 4.0 kbps. This is because of the relative ability of the fixed codebooks to model the associated inverse error signal. That is, if coding distortions are introduced by inefficiencies in the LTP, and those distortions can be effectively modeled by the fixed codebook, then the net effect is that the distortion will be canceled. So, while the EVRC full rate mode allocates 120 of 170 its per frame for fixed codebook gain and shape, the half rate mode can afford only 42 of 80 bits per frame for the same. This results in a disproportionate performance degradation due, in part, to the fixed codebook's inability to model the coding distortion introduced by the LTP.

Therefore, there is a need for an improved method of open-loop pitch estimation that provides subsample resolution.

DETAILED DESCRIPTION OF THE PREFERRED EMBODIMENT

Stated generally, a method and apparatus for improved pitch period estimation in a compression system is disclosed. The system uses original estimates of integer lag and open-loop prediction gain as input to an adaptive filter parameter initialization block which supplies inputs to a plurality of adaptive filter elements. Adaptive filter elements provide information regarding the harmonics of the residual signal to an adaptive filter parameter analysis block. Adaptive filter parameter analysis block estimates the fundamental frequency of the residual signal based on the analysis of the harmonics and outputs a pitch period for eventual use in a delay contour computation.

Stated more specifically, a method for estimating a fundamental frequency of a signal includes the steps of analyzing harmonics of the signal and estimating the fundamental frequency of the signal based on the analysis of the harmonics. In the preferred embodiment, the step of analyzing harmonics of the signal further comprises phase locking to the harmonics of the signal and the step of estimating further comprises quantizing the fundamental frequency of the signal and converting the quantized fundamental frequency of the signal to the lag domain for use as a pitch period $\tau$. In this embodiment, the signal further comprises a residual of a speech coded signal.

Figures 1, 2:
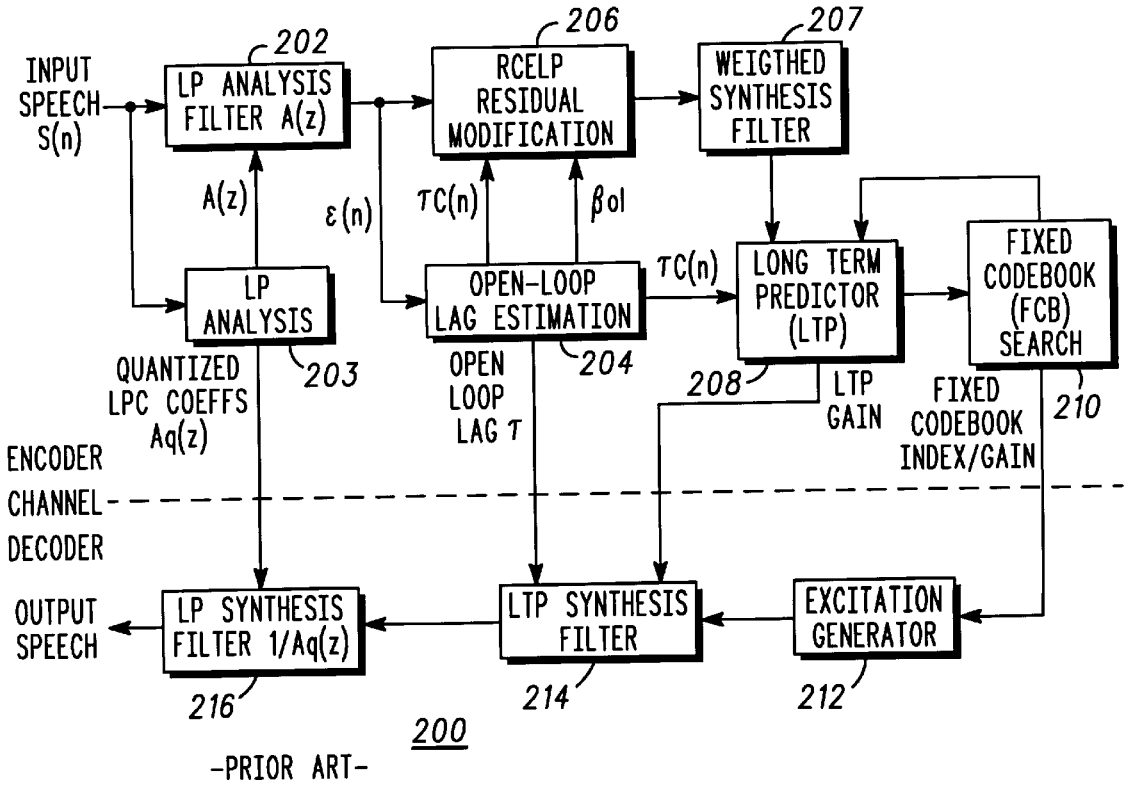
FIG. 1 generally depicts fractional lag values for a GSM half-rate speech coder.
FIG. 2 generally depicts a speech compression system employing open-loop lag estimation as is known in the prior art.

FIG. 2 generally depicts a speech compression system 200 employing open-loop lag estimation as is known in the prior art. As shown in FIG. 2, the input speech signal s(n) is processed by an linear prediction (LP) analysis filter 202 which flattens the short-term spectral envelope of input speech signal s(n). The output of the LP analysis filter is designated as the LP residual $\epsilon(n)$. The LP residual signal $\epsilon(n)$ is then used by the open-loop lag estimator 204 as a basis for estimating the delay contour $\tau_c(n)$ and the open-loop pitch prediction gain $\beta_{ol}$. The RCELP residual modification process 206 uses this information to map the LP residual to the delay contour, as described above. The modified residual signal is then passed through a weighted synthesis filter 207 before being processed by the long term predictor 208 and eventually by the fixed codebook 210, which characterizes the synthesizer excitation sequence. At the decoder side, the fixed codebook index/gain is input to an excitation generator 212 which outputs an excitation sequence. The excitation sequence is passed through long and short term synthesis filters 214 and 216 to produce the reconstructed speech output.

Figure 3:
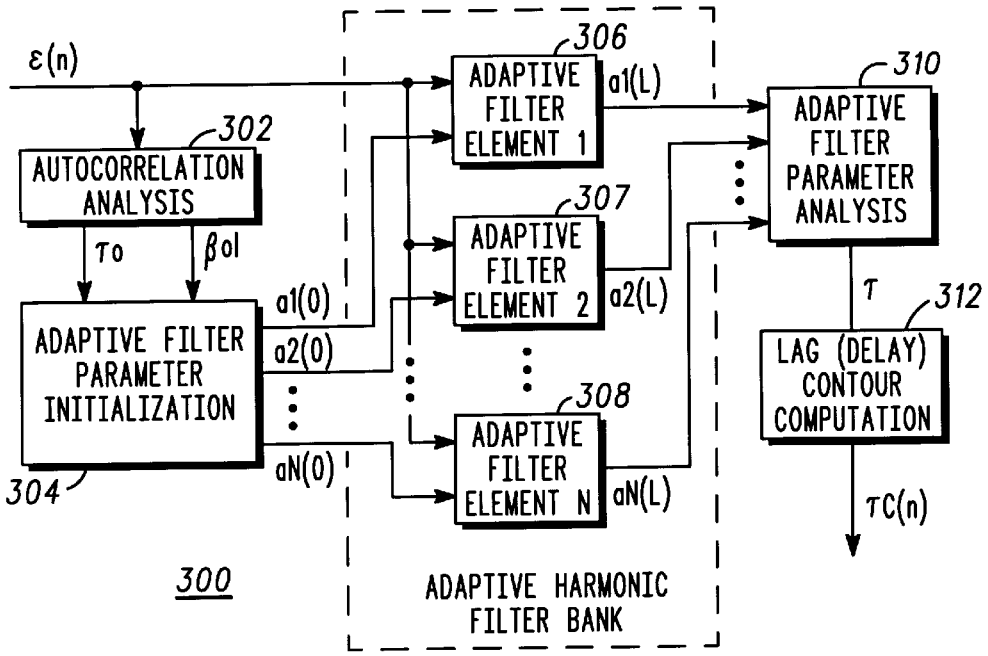
FIG. 3 generally depicts a open-loop lag estimation system in accordance with the invention.

In the preferred embodiment of the present invention, a more accurate estimate of the RCELP delay contour is produced which results in a more accurate mapping of the delay contour to the LP residual signal $\epsilon(n)$. FIG. 3 generally depicts a open-loop lag estimation system 300 in accordance with the invention. As shown in FIG. 3, the LP residual signal $\epsilon(n)$ is used as the input to the autocorrelation analysis block 302 which uses the prior art method shown in section 4.2.3 of IS-127 as "pre-optimized" values for the integer lag $\tau_0$ and open-loop prediction gain $\beta_{ol}$. These values are then used to calculate the initial parameters for the adaptive harmonic filter bank. The filter bank is used to estimate the residual signal's fundamental frequency $f_0$ by "phase locking" to the LP residual harmonic frequencies. The fundamental frequency is then quantized and converted to the lag domain for use as the optimal pitch period $\tau$ in accordance with the invention.

To explain open-loop lag estimation in accordance with the invention, it is given [6] that the complex conjugate roots of the recursive digital filter are of the form:

$$H(z) = \frac{\gamma}{(1 - re^{j\omega_0}z^{-1})(1 - re^{j\omega_0}z^{-1})} = \frac{\gamma}{1 - 2r\cos(\omega_0)z^{-1} + r^2z^{-2}} \tag{2}$$

which results in a bandpass frequency response with center frequency $\omega_0$. As the value of r approaches 1, the filter response becomes more and more narrow, and the filter structure can be classified as a digital resonator. A value of r=1 results in oscillation, and values of r>1 result in instability. The value of $\gamma$ that yields unity gain at the center frequency $\omega_0$ is given as:

$$\gamma = (1 - r)\sqrt{1 + r^2 - 2r\cos 2\omega_0}\,. \tag{3}$$

Furthermore, by modifying H(z) to include a unit delay in the numerator:

$$H(z) = \frac{\gamma z^{-1}}{1 - 2r\cos(\omega_0)z^{-1} + r^2z^{-2}} \tag{4}$$

the phase response is such that there is a phase shift of $-\pi/2(-90°)$ at the center frequency $\omega_0$, and an asymptotical approach to 0 and $-\pi$ on the low and high frequency sides of $\omega_0$, respectively. This is an important point because for an input signal x(n), the output signal y(n) would be orthogonal to the input when evaluated at $\omega_0$. Extending this idea to an adaptive filter context, let us consider the following time varying transfer function:

$$H(q, n) = \frac{\gamma q^{-1}}{1 - a(n)q^{-1} - bq^{-2}}, \tag{5}$$

where $q^-$is a unit delay operator and n represents the sampled time index. For a sinusoidal input, if a(n) were allowed to vary until the output of the filter were orthogonal to the input, the frequency of the input $\omega_{in}$ could be determined at time n by the relation:

$$\omega_{in} = \cos^{-1}(a(n)/2r). \tag{6}$$

Figure 4:
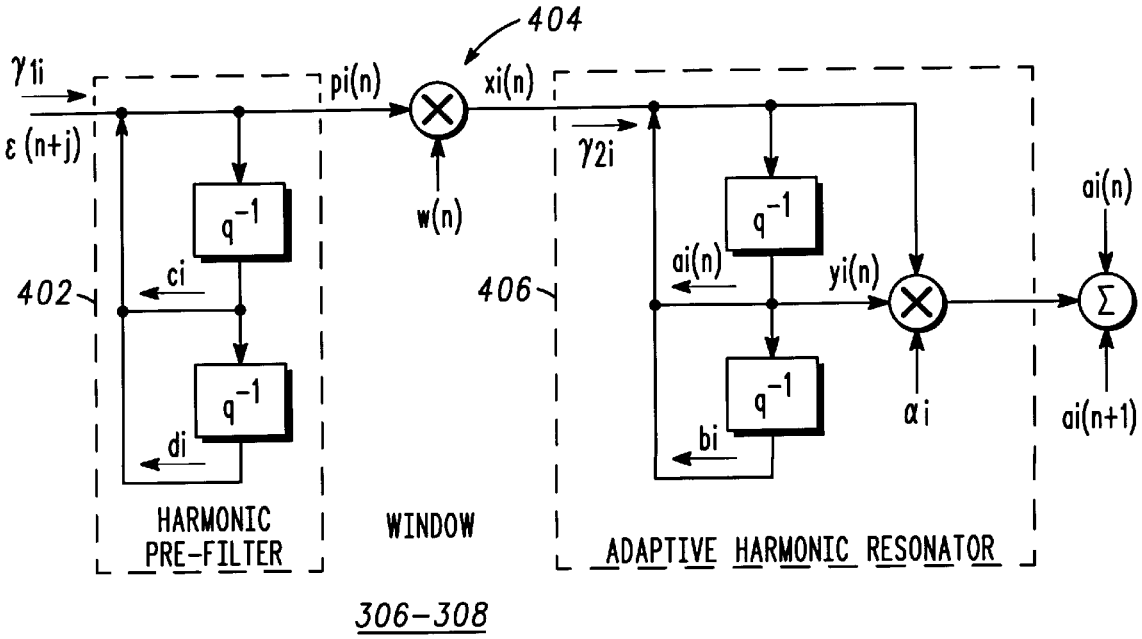
FIG. 4 generally shows the structure of an ith adaptive filter element within the filter bank of FIG. 3.

This is the basic premise of the invention. The input signal $\epsilon(n)$ is used as an input to a filterbank of adaptive filter elements 306–308. Each of the adaptive filter elements 306–308 pre-filters the residual at a fixed harmonic frequency. FIG. 4 shows the corresponding structure of an ith adaptive filter element, for example adaptive filter element 306, contained within the filter bank of FIG. 3. The pre-filtered output is windowed 404 to prevent spurious signal conditions, and then used as input to an adaptive resonator 406 of the form given in Eq. (5). Once the data for the current frame has been processed, the adaptive filter coefficients for each of the harmonics is analyzed, and an estimate of the fundamental frequency is generated.

The LP residual signal $\epsilon(n)$ is first filtered by the zero-state harmonic pre-filter 402, given as:

$$p_i(n) = \gamma_{1i}\epsilon(n+j) + c_i p_i(n-1) + d_i p_i(n-2),\ 0 \leqq n < L,\ 1 \leqq i \leqq N, \tag{7}$$

where N is the number of harmonics to be analyzed, and the filter coefficients are given as:

$$\left.\begin{aligned} c_i &= 2r_1\cos\omega_i \\ d_i &= -r_1^2 \end{aligned}\right\}, 1 \le i \le N. \tag{8}$$

In this expression, the pole radius is given as the constant $r_1$=0.989 and the harmonic frequency $\omega_i$ is given as:

$$\omega_i = \frac{2\pi}{\tau_0}(h+i-1), 1 \le i \le N, \tag{9}$$

where $\tau_0$ is the pre-optimized lag from autocorrelation analysis block 302, h is the harmonic number corresponding to the smallest frequency greater than the minimum frequency $f_{min}$:

$$h = \left\lceil \frac{\tau_0 f_{\min}}{f_s} \right\rceil, \tag{10}$$

and $ff_s$ is the sampling frequency. In this embodiment, $f_{min}$=800 Hz,$f_s$=8000 Hz, and N=4 harmonics. So, for example, if the lag $\tau_0$ were chosen to be 40, the harmonic filter bank would be configured to analyze the 4th through 7th harmonics of the fundamental frequency $f_0=f_s/\tau_0$=200 Hz, or more explicitly 800, 1000, 1200, and 1400 Hz.

Referring back to Eqs. (3) and (7), the filter gain variable $\gamma_{1i}$ can then be calculated as:

$$\gamma_{1i} = (1-r_1)\sqrt{1+r_1^2-2r_1\cos 2\omega_i}, 1 \le i \le N. \tag{11}$$

In some applications, however, it may be more desirable (from a complexity standpoint) to hold this value constant across the range of allowable frequencies, however, care must be taken to assure that the adaptive filter gains are not biased as a result.

Also in Eq. (7), two symbols require definition. First, the sequence length L is defined such that at least three full pitch periods must be contained within the LP residual signal $\epsilon(n)$, up to a given maximum. This guarantees a meaningful input to the adaptive filters 306–308. The sequence length L can then be defined as:

$$L = \begin{cases} 3L_f/2, & \tau_0 \le L_f/2 \\ 3\tau_0, & L_f/2 < \tau_0 < 2L_f/3, \\ 2L_f, & \text{otherwise} \end{cases} \tag{12}$$

where $L_f$=160 is the frame length of this embodiment. The associated variable offset j into the input sequence $\epsilon(n)$ can then be expressed as:

$$j = \begin{cases} L_f/2, & \tau_0 \le L_f/2 \\ 2L_f - 3\tau_0, & L_f/2 < \tau_0 < 2L_f/3. \\ 0, & \text{otherwise} \end{cases} \tag{13}$$

Figures 5, 6:
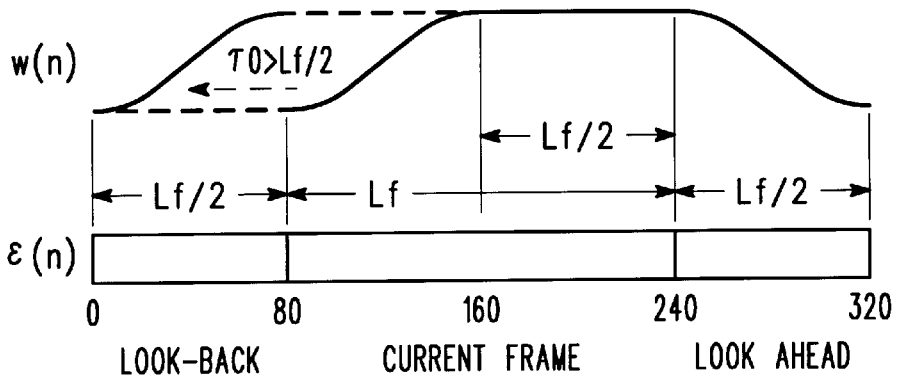
FIG. 5 generally depicts the process of variable length sequencing, variable offset, and subsequent windowing in accordance with the invention.
FIG. 6 generally depicts an example of an m=7 bit trained scalar quantization table in accordance with the invention.

The process of variable length sequencing, variable offset, and subsequent windowing can be more readily observed in FIG. 5. In this embodiment, the LPC residual sequence $\epsilon(n)$ consists of 320 samples of information, the first 80 of which represent the last half of the last frame of information. These are used to "prime" the state of the LP analysis filter 202 and are used here to extend the pitch analysis frame for low frequencies. The next 160 samples represent the current frame of information, and the following 80 samples represent the "look-ahead" to the next frame. Since RCELP attempts to interpolate the lag from frame-to-frame, it is desirable to estimate the lag corresponding to the point at the end of the current frame. To do this adequately, a "look-ahead" to the next frame thereby centering the analysis frame towards the end of the current frame must occur. In the event that the initial lag is greater than half a frame length, however, the analysis frame is elongated towards past samples. This is a conscious effort to not increase algorithmic delay by not increasing the length of the look-ahead. Using this method, the sequence length L is equal to 240 for lags ≦80. For lags >80 and ≦120, the analysis window is stretched back in time successively until the beginning of the look-back of the previous frame is reached.

Also implicit in FIG. 5 is the windowing 404 of the pre-filtered output sequence $p_i(n)$, which can be expressed as:

$$x_i(n)=w(n)p_i(n),\ 0 \le n < L,\ 1 \le i \le N, \tag{14}$$

where $\omega(n)$ is the window:

$$w(n) = w(L-1-n) = \begin{cases} \sin^2(\pi(n+0.5)/L_f), & 0 \le n < L_f/2 \\ 1, & L_f/2 \le n < L/2 \end{cases}. \tag{15}$$

The window $\omega(n)$ can be described as a smoothed trapezoid window. Other window types may be used with varying degrees of performance, however, keeping the window "tails" constant is a computational advantage since only $L_f/2$ samples need be stored or calculated. Other window types that have dependence on L in the trigonometric function e.g., $\sin^2(\pi(n+0.5)/L)$) would require recalculation and/or different storage memory for each value of L.

The windowed pre-filter output x(n) is then used as input to a zero-state adaptive harmonic resonator 406 of the form:

$$y_i(n)=\gamma_{2i}x(n)+a_i(n)y_i(n-1)+b_iy_i(n-2),\ 0 \le n < L,\ 1 \le i \le N, \tag{16}$$

where the fundamental difference between this and the pre-filter in Eq. (7) is that the filter coefficient corresponding to the filter resonant frequency $a_i(n)$ in Eq. (16) is allowed to vary with time. The initial coefficient values are calculated as in Eq.(8) as:

$$\left.\begin{aligned} a_i(0) &= 2r_2\cos\omega_i \\ b_i &= -r_2^2 \end{aligned}\right\}, 1 \le i \le N. \tag{17}$$

where the pole radius is $r_2$=0.989 and the resonant frequency $\omega_i$ is given in Eqs. (9) and (10). The filter gain term is also calculated as in Eq. (11) by:

$$\gamma_{2i} = (1-r_2)\sqrt{1+r_2^2-2r_2\cos 2\omega_i}, 1 \le i \le N. \tag{18}$$

As the windowed pre-filter sequence is passed through the second filter 406, which in the preferred embodiment is an adaptive harmonic resonator 406, the resonant frequency coefficient for each harmonic is modified according to:

$$a_i(n+1)=a_i(n)+\alpha_i x_i(n)y_i(n-1),\ 0 \le n > L,\ 1 \le i \le N, \tag{19}$$

where $a_i$ is the normalized adaptation gain given by:

$$\alpha_i = \frac{\alpha_1 \beta_{ol}}{k + \sum_{n=0}^{L-1} x_i^2(n)}, \; 1 \le i \le N. \tag{20}$$

In this embodiment, the gain constant $\alpha_1$=0.49, the reciprocal limiting constant k=150, and the open-loop prediction gain (obtained from the autocorrelation analysis block in FIG. 3) has the range $0 \leqq \beta_{ol} \leqq 1$. These values assume the input speech to be normalized within the 16 bit range ±32767. Also in this embodiment, the gain term depends on the entire L samples to be passed through the pre-filter/window prior to the execution of the adaptive filter.

Once all L samples have been passed through the adaptive harmonic filter 406, the coefficients $a_i(L)$ can be analyzed for deviation from the initial center frequencies. The inverse of Eqs. (8) and (9) can be applied to each of the harmonic elements of the filter bank to form the following estimation of the unquantized fundamental frequency $f_0$:

$$f_0 = \frac{f_s}{2\pi} \sum_{i=1}^{N} \lambda(i) \frac{\cos^{-1}(a_i(L)/2r_2)}{h+i-1}, \tag{21}$$

where λ(i) is a weighting function that appropriately weights the importance of each of the harmonic elements, such that the sum of all elements of λ(i) equal unity. In this embodiment, λ(i) is equal to a linear average, or λ(i)=1 /N, $1 \leqq i \leqq N$. λ(i) is highly dependent on the input data; other functions may or may not yield better performance.

The quantized value of the fundamental frequency $f^*$ is then found by choosing the value of the index k that minimizes the following:

$$\min \{(f_0 - f_{table}(k))^2\}, \; 0 \leqq k > 2^m, \tag{22}$$

where $f_{table}(k)$ are the allowable values of the quantized fundamental frequency and m is the number of bits allocated to the lag parameter. An example of an m=7 bit trained scalar quantization table is given in FIG. 6.

The quantized fundamental frequency $f^*$ can then be used to generate the corresponding delay contour $\tau_c(n)$ which is output from the lag contour computation block 312 of FIG. 3, for which the following example is given as:

$$\tau_c(n) = \begin{cases} \tau(m-1) + (n(\tau(m-1) - \tau(m)))/L_f, & |\tau(m-1) - \tau(m)| < 16 \\ \tau(m), & \text{otherwise} \end{cases}, \quad 0 \le n < L_f \tag{23}$$

where $\tau = f_s/f^*$, m represents the current frame and m−1 is the previous frame. In this equation, the interpolated lag is considered valid only if the trajectory does not change too abruptly.

In the preferred embodiment, a database of over 80,000 frames of speech and music signals was used to generate the data shown in FIG. 6 based on the dataset's probability density function. While this data is statistically optimal over the various fundamental frequency values from the training set, it is interesting to note that the distribution more closely reflects the properties of the human auditory system. That is, psychoacoustics principles reveal that the critical bands of hearing are uniform in frequency below 500 Hz; in the prior art open-loop lag estimator shown in FIG. 2, the distribution of quantization range is uniform over pitch period, which is inversely proportional to frequency. Thus, for a given fundamental frequency range of say 66 to 400 Hz, the psychoacoustically optimal distribution for a 7 bit quantizer would consist of a uniform frequency distribution spaced at 2.6 Hz intervals. The table shown in FIG. 6 yields relatively constant spacing through about 250 Hz (τ=32), but then sharply increases to about 20 Hz at the end frequency of about 400 Hz (τ≈20). This decrease in resolution is due to the diminished probability of encountering very high frequency talkers. So, the present invention facilitates the combination of both statistically and psychoacoustically joint optimal datasets by allowing arbitrary quantization levels for the fundamental frequencies. This is not readily achievable in the prior art.

Figures 7, 8:
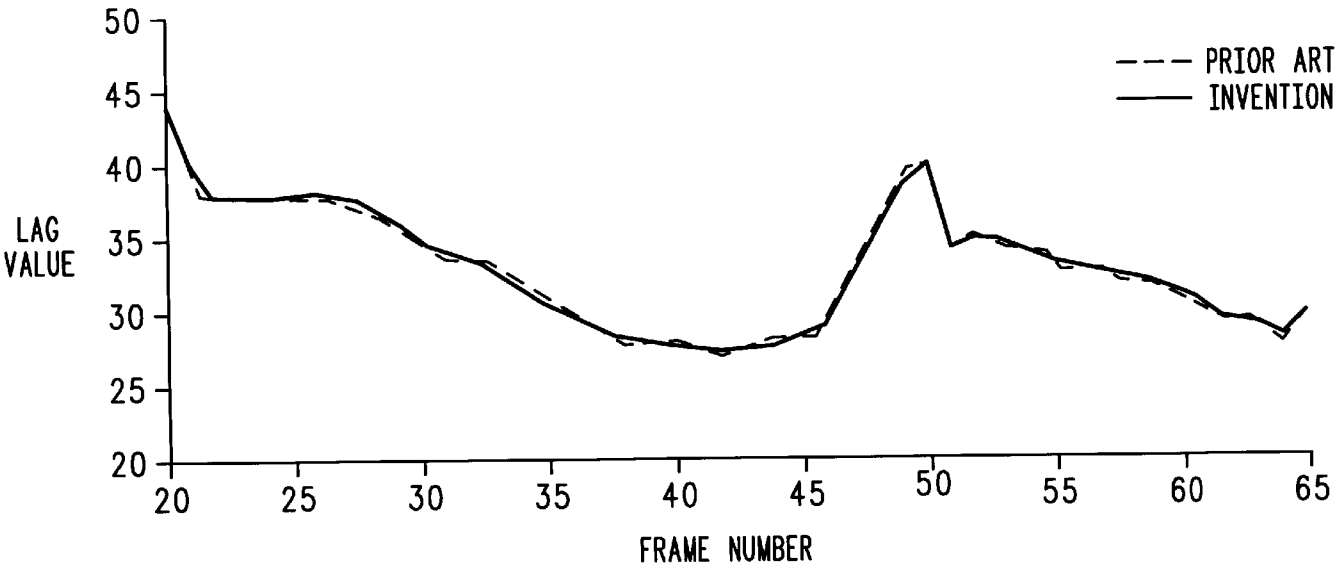
FIG. 7 generally depicts a comparison of voiced speech lag estimation between a prior art method and lag estimation in accordance with the invention.
FIG. 8 generally depicts a comparison of average absolute accumulated shift between a prior art method and lag estimation in accordance with the invention.

The support for objective improvement can be observed in FIG. 7, where the lag trajectory for a short passage of strongly voiced speech is shown. While the prior art shows distinct "staircase" effects during transitional (frames 52 to 58 ) and steady state (frames 37 to 45 ) passages, the lag estimation in accordance with the invention effectively smoothes out the rough edges associated with the integer lag boundaries.

As described above, improvements to the RCELP algorithm can be evaluated objectively by measuring the accumulated shift that results from the inability of the LP residual signal ε(n) to be appropriately mapped to the estimated delay contour. Since one purpose of the preferred embodiment in accordance with the invention is to more accurately estimate the RCELP delay contour, the efficiency of the RCELP algorithm is improved since lag estimation in accordance with the invention requires less error to be tolerated by lowering the accumulated average shift factor. The improvement can be observed in FIG. 8, which was generated from a 80,000+ frame database.

Additionally, the subjective performance improvement is highly audible. Testing shows consistent preference to lag estimation in accordance with the invention during blind A/B tests, and it is estimated that the inventive method and apparatus provides 0.1 to 0.2 Mean Opinion Score (MOS) points improvement in Absolute Category Rating (ACR) tests when used with the EVRC half-rate maximum mode of operation (4.0 kbps).

While the invention has been particularly shown and described with reference to a particular embodiment, it will be understood by those skilled in the art that various changes in form and details may be made therein without departing from the spirit and scope of the invention. For example, one skilled in the art will recognize that lag estimation in accordance with the invention can additionally benefit other, more general algorithms/vocoders which require accurate open-loop estimation of the fundamental frequency of an input signal. Such algorithms/vocoders include, but are not limited to, harmonic vocoders, sinusoidal transform coders (STC), and homomorphic vocoders. In addition to cellular communication systems, other applications which may benefit include digital hearing aids, audio speech coders, voice mail systems, etc. The corresponding structures, materials, acts and equivalents of all means or step plus function elements in the claims below are intended to include any structure, material, or acts for performing the functions in combination with other claimed elements as specifically claimed.

What we claim is:

1. In an open-loop lag estimation system for use in a speech compression system, a method for estimating a fundamental frequency with improved pitch period estimation of a linear prediction residual signal, the method comprising the steps of:

receiving the linear prediction residual signal;

generating an integer lag and an open-loop prediction gain of the linear prediction residual signal;

generating a plurality of initial parameters using the integer lag and the open-loop prediction gain;

estimating the fundamental frequency of the linear prediction residual signal using the plurality of initial parameters.

2. A method as recited in claim 1, wherein the estimating step comprises phase locking to a plurality of linear prediction residual harmonic frequencies of the linear prediction residual signal.

3. A method as recited in claim 2, wherein the estimating e further comprises quantizing the fundamental frequency of the linear prediction residual signal and converting the quantized fundamental frequency of the linear prediction residual signal to a lag domain for use as a pitch period.

4. In a speech compression system, an open-loop lag estimation system for estimating a fundamental frequency with improved pitch period of a linear prediction residual signal, wherein the open-loop lag estimation system comprises:

an autocorrelation analysis block for receiving the linear prediction residual signal, wherein the autocorrelation analysis block produces an integer lag and an open-loop prediction gain;

an adaptive filter parameter initialization block coupled to the autocorrelation analysis block and receiving the integer lag and the open-loop prediction gain, wherein the adaptive filter parameter initialization block produces a plurality of initial parameters;

an adaptive harmonic filter bank coupled to the adaptive filter parameter initialization block, wherein the adaptive harmonic filter bank receives the plurality of initial parameters, and further wherein the adaptive harmonic filter bank estimates the fundamental frequency of the linear prediction residual signal using the plurality of initial parameters.

5. An open-loop lag estimation system as recited in claim 4, wherein the adaptive harmonic filter bank estimates the fundamental frequency of the linear prediction residual signal by phase locking to a plurality of linear prediction residual harmonic frequencies of the linear prediction residual signal.

6. An open-loop lag estimation system as recited in claim 5, wherein the adaptive harmonic filter bank further quantizes the fundamental frequency of the linear prediction residual signal, and further wherein the adaptive harmonic filter bank converts the quantized fundamental frequency of the linear prediction residual signal to a lag domain for use as a pitch period.

* * * * *